United States Patent [19]

Wrege et al.

[11] 4,152,756

[45] May 1, 1979

[54] RAILROAD CROSSING SIGNAL LAMP

[75] Inventors: Warren R. Wrege; Ronald W. Dinger; Robert A. Hagen, all of Rochester, N.Y.; Chester A. Hard, III; J. T. Barnes, both of Charlevoix, Mich.

[73] Assignee: General Signal Corporation, Rochester, N.Y.

[21] Appl. No.: 810,338

[22] Filed: Jun. 27, 1977

[51] Int. Cl.[2] ..... F21S 1/04; F21V 5/04

[52] U.S. Cl. ..... 362/152; 362/76; 362/291; 362/337; 362/340

[58] Field of Search ..... 362/76, 77, 152, 268, 362/290, 291, 337, 389, 340

[56] References Cited

U.S. PATENT DOCUMENTS

| | | | |
|---|---|---|---|
| 1,290,567 | 1/1919 | Jester | 362/339 |
| 1,310,721 | 7/1919 | Waggoner | 362/339 |
| 1,582,326 | 4/1926 | Wood | 362/290 |
| 2,119,370 | 5/1938 | Van Leunen | 362/290 |
| 2,855,500 | 10/1958 | Holman | 362/340 |
| 3,235,863 | 2/1966 | Lockhart | 362/337 X |
| 3,267,279 | 8/1966 | Doolittle | 362/268 |
| 3,522,424 | 8/1970 | Fritsch | 362/268 |

*Primary Examiner*—Peter A. Nelson

*Attorney, Agent, or Firm*—Pollock, Vande Sande & Priddy

[57] ABSTRACT

An improved railroad crossing signal includes a deep dish parabolic reflector and an essentially flat plastic lens angled forward at the top relative to the axis of the reflector. The lens includes prism elements for laterally dispersing parallel light from the reflector more toward the crossing highway at near and far distances than toward the adjacent land. The lens also includes prism elements for vertically dispersing a portion of the light to produce uniform brightness before the signal.

14 Claims, 15 Drawing Figures

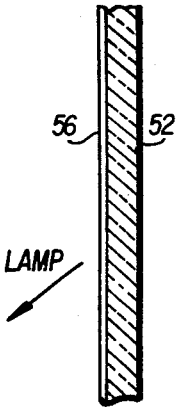
FIG. 8
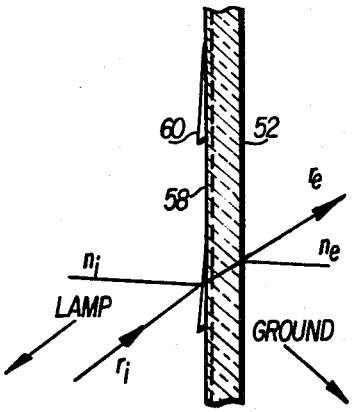
FIG. 9
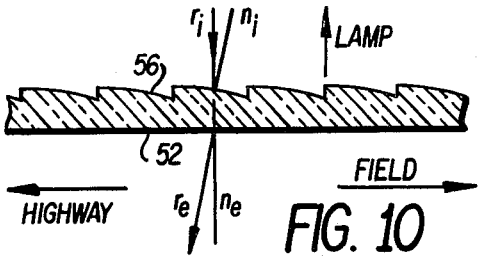
FIG. 10
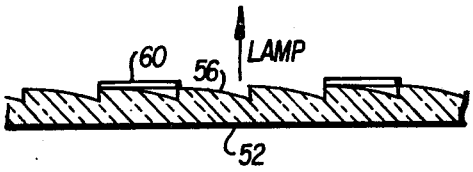
FIG. 11
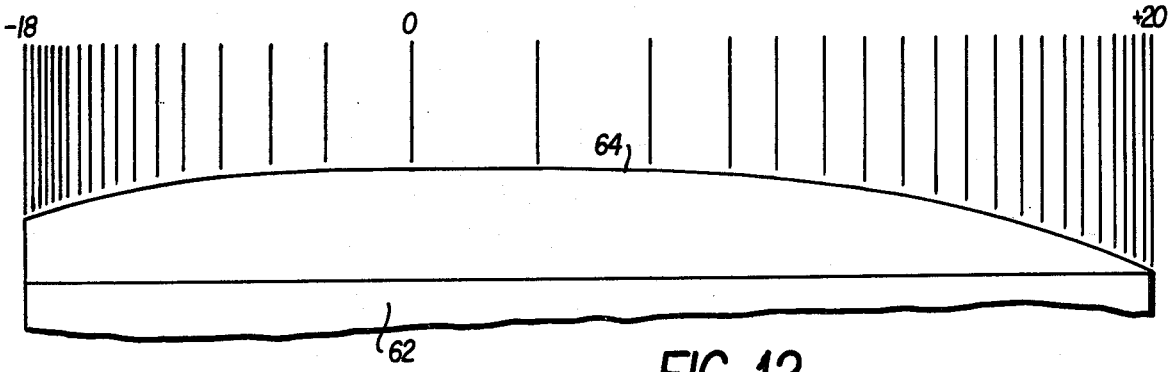
FIG. 12
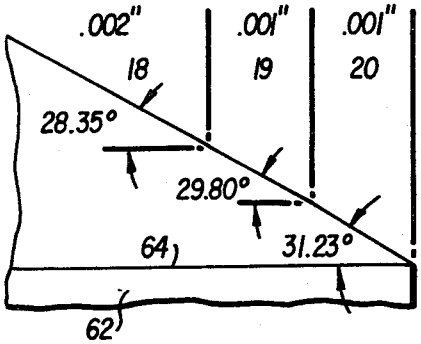
FIG. 13
FIG. 15
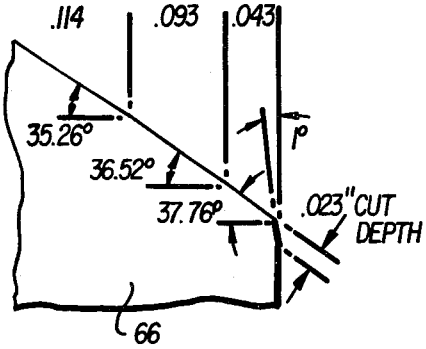

| FACET No. | B | $-\alpha$ |
|---|---|---|
| -18 | .001 | -28.35° |
| -17 | .001 | -26.88 |
| -16 | .001 | -25.38 |
| -15 | .001 | -23.86 |
| -14 | .001 | -22.32 |
| -13 | .001 | -20.75 |
| -12 | .002 | -19.17 |
| -11 | .002 | -17.57 |
| -10 | .002 | -15.95 |
| -9 | .002 | -14.32 |
| -8 | .003 | -12.67 |
| -7 | .003 | -11.01 |
| -6 | .004 | -9.33 |
| -5 | .005 | -7.65 |
| -4 | .006 | -5.96 |
| -3 | .009 | -4.26 |
| -2 | .014 | -2.56 |
| -1 | .021 | -.85 |

| FACET No. | B | $+\alpha$ |
|---|---|---|
| 0 | .028 | .0° |
| 1 | .026 | .85 |
| 2 | .024 | 2.56 |
| 3 | .011 | 4.26 |
| 4 | .010 | 5.96 |
| 5 | .009 | 7.65 |
| 6 | .008 | 9.33 |
| 7 | .008 | 11.01 |
| 8 | .007 | 12.67 |
| 9 | .006 | 14.32 |
| 10 | .005 | 15.95 |
| 11 | .005 | 17.57 |
| 12 | .004 | 19.17 |
| 13 | .004 | 20.75 |
| 14 | .003 | 22.32 |
| 15 | .003 | 23.86 |
| 16 | .002 | 25.30 |
| 17 | .002 | 26.88 |
| 18 | .002 | 28.35 |
| 19 | .001 | 29.80 |
| 20 | .001 | 31.23 |

FIG. 14

RAILROAD CROSSING SIGNAL LAMP

BACKGROUND OF THE INVENTION

For many years, the red signal lamps commonly seen at railroad crossings have included a roundel type lens which disperses light from a bulb behind the lens in essentially equal proportion to areas in front of, to both sides of, above and below the lamp. Provision is frequently made for passing a certain amount of light straight through the lens without dispersion, to provide adequate brightness at long distances in front of the lamp. The familiar signal lamp includes a long hood or visor which keeps snow and ice from obscuring the lens and a circular background ring surrounding the roundel which provides contrast with ambient light sources. A variation of this familiar lamp, disclosed in U.S. Pat. No. 3,597,606, includes a lens set at an angle at one end of an elongated housing cover, so that the need for a visor is substantially eliminated.

The regulations of the Association of American Railroads require that each crossing signal be provided with a standby battery for use during emergencies so that signal operation will be ensured for a specified length of time at specified light intensities in certain areas before the signal lamp. To satisfy these requirements, rather large capacity batteries are required, at considerable expense to the railroad companies. One reason that such large batteries must be used is a function of the design of the lenses commonly used in prior art signal lamps. As previously mentioned, the prior art lenses disperse light to the entire area in front of the lamp. Thus, light is directed at the fields or buildings adjacent the roadway which crosses the railroad tracks, at the ground in front of the signal, as well as into the eyes of vehicle operators approaching the crossing on the highway. Clearly, this results in a waste of much of the power of the emergency battery to illuminate areas other than the adjacent highway. If means were provided for directing the light preferentially toward the roadway while still ensuring adequate brilliance at other angles, then the battery requirements would be reduced with attendant savings. A lower power battery could be used to produce the required light intensity in the highway area where the signal must be seen at all events and reduced intensity in other areas. Conversely, present batteries could continue to be used with increased light intensity in the highway area.

OBJECTS OF THE INVENTION

An object of the invention is to provide an improved railway crossing signal which preferentially disperses signal light to the highway area, rather than to adjacent buildings or fields.

Another object of the invention is to provide an improved lens for use with railway crossing signals which can be retro-fitted to existing signal lamp housings.

Yet another object of the invention is to provide an improved signal lamp which has fewer parts than prior art lamps.

Still another object of the invention is to provide an improved signal lamp which will eliminate the need for back lights used in the prior art.

A further object of the invention is to provide a signal lamp housing of molded plastic in which a deep-dish parabolic reflector is formed as the rear portion of the housing wall, the reflector being metallized directly onto the inner surface of the housing wall.

A still further object of the invention is to provide an improved lens design which will preferentially direct light to the adjacent highway, yet will be adequately brilliant to appear as a bright, round signal from most angles in front of the lamp.

These objects are given only by way of example. Thus, other desirable objectives and advantages inherently achieved by the disclosed signal lamp may be perceived by those skilled in the art. Nonetheless, the scope of the invention is to be limited only by the appended claims.

SUMMARY OF THE INVENTION

The above objects and other advantages are achieved with the signal lamp according to the invention which includes a housing having a parabolic reflector and a clear envelope bulb mounted at the focus of the parabola. The lens of the lamp includes multi-faceted prism elements, some of which disperse light laterally to predetermined areas and some of which disperse light vertically. The lateral dispersion ensures that light of sufficient intensity is directed to the roadway for observation by on-coming motorists and pedestrians; whereas, the vertical dispersion provides good, uniform brightness from all angles.

BRIEF DESCRIPTION OF THE DRAWINGS

FIG. 8 shows a view taken on line 8—8 of FIG. 7.

FIG. 9 shows a view taken on line 9—9 of FIG. 7.

FIG. 10 shows a view taken on line 10—10 of FIG. 7.

FIG. 11 shows a view taken on line 11—11 of FIG. 7.

FIG. 12 shows a plan view of the cutter geometry used to make the lens of FIG. 7.

FIG. 13 shows an enlarged view of the right hand end of the cutter shown in FIG. 12.

FIG. 14 shows a table of angles and distances for the cutter of FIGS. 12 and 13.

FIG. 15 shows a plan view of a cutter geometry used to make the lens of FIG. 7.

DETAILED DESCRIPTION OF THE PREFERRED EMBODIMENTS

Figure 1:
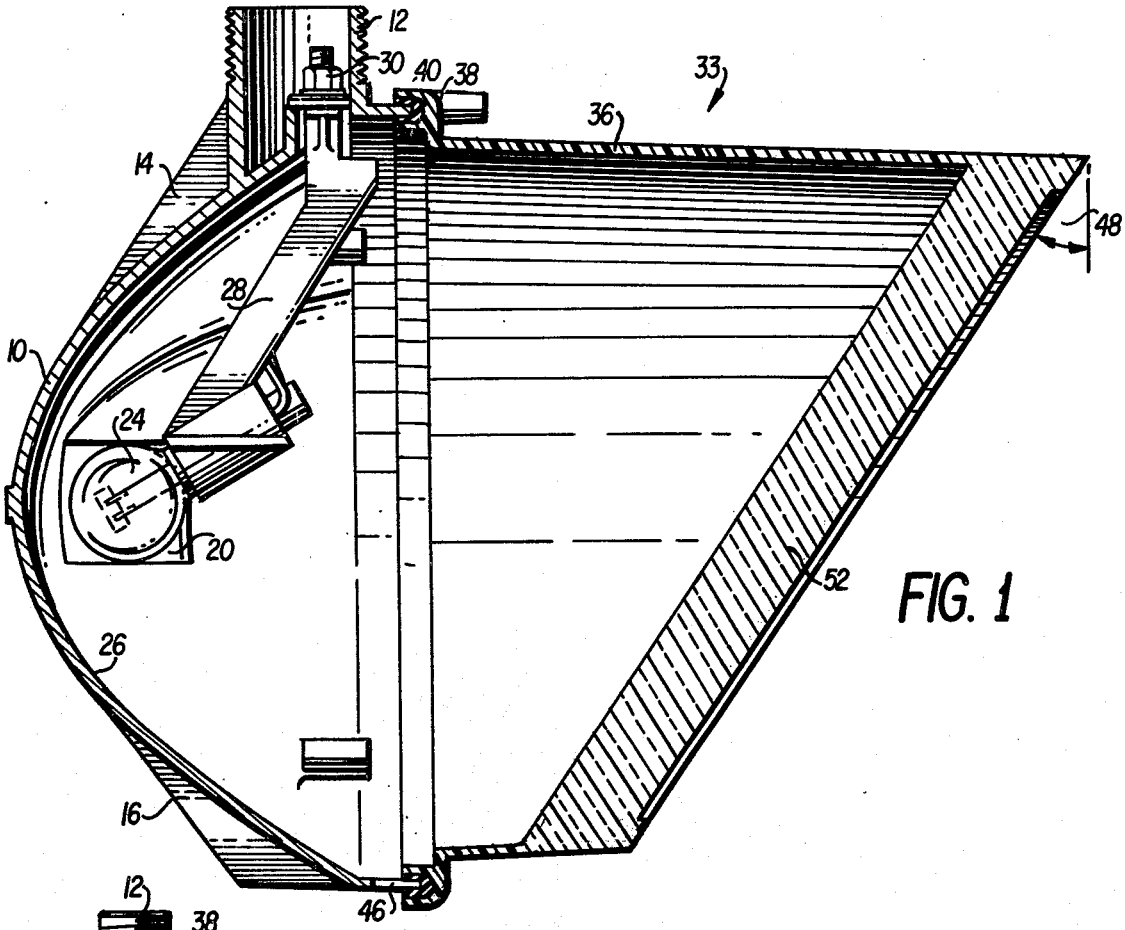
FIG. 1 shows an elevation view in section through a signal lamp embodying the invention, taken from the left side thereof as viewed from the front.
Figure 2:
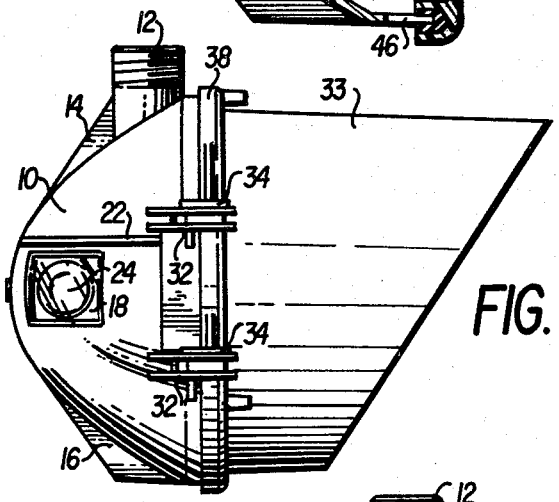
FIG. 2 shows an elevation view of the left side of a lamp embodying the invention.
Figure 3:
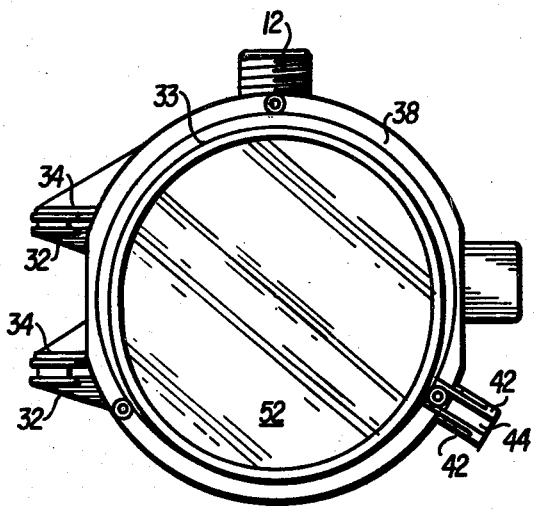
FIG. 3 shows a front elevation view of a lamp embodying the invention.
Figure 4:
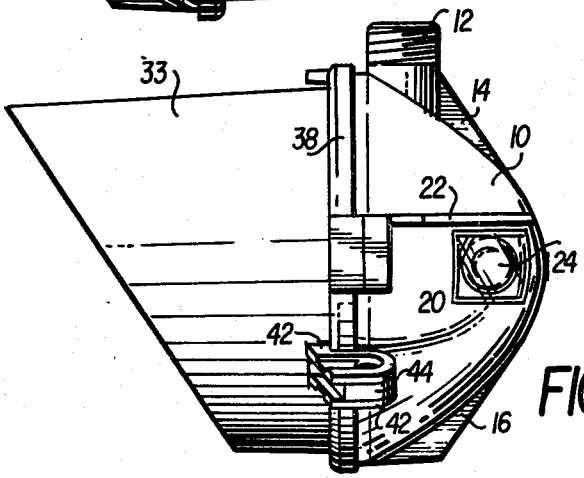
FIG. 4 shows an elevation view of the right side of a lamp embodying the invention.
Figure 5:
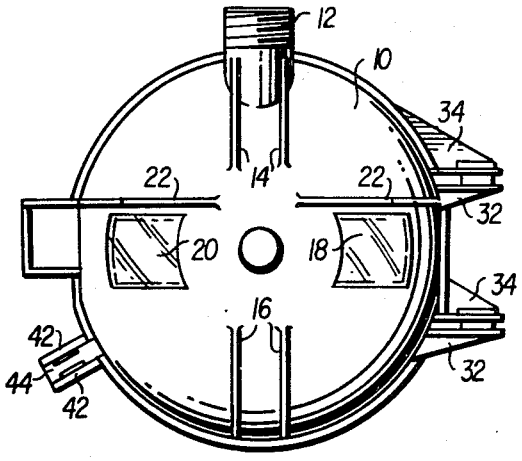
FIG. 5 shows a rear elevation view of a lamp embodying the invention.
Figure 6:
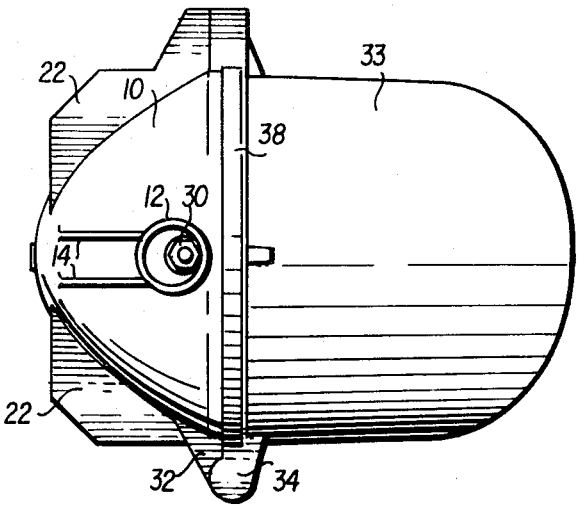
FIG. 6 shows a top view of a lamp embodying the invention.

There follows a detailed description of the preferred embodiments of the invention, reference being made to the drawings in which like reference munerals identify like elements of structure in each of the several figures.

Referring collectively to FIGS. 1 to 6, the overall geometry of the signal lamp according to the invention may be understood. An essentially cup-shaped housing 10 comprises an upwardly extending, threaded, hollow boss 12 which is used to attach the lamp to existing support structure at a railroad crossing. Housing 10 is preferably molded from black polycarbonate plastic, though other materials may be used. For example, the housing could also be made from clear white or colored plastic, or opaque plastic, and then painted the desired exterior color, usually black. On the back surface of housing 10, spaced pairs of vertical stiffening ribs 14 and 16 are provided on either side of the housing center line. When the housing is molded from plastic, these ribs may be formed integrally with it, as illustrated. On opposite sides of housing 10, located toward the rear thereof, a pair of side light windows 18 and 20 are provided which direct some light up and down the railroad tracks so that the train crew can confirm that the signal is operating. Windows 18 and 20 are closed by clear, distinctively colored lenses in use. When housing 10 is molded from a clear, distinctively colored plastic, the lenses preferably are formed integrally with the housing and silvered on their interior surfaces using known vacuum deposition techniques to minimize light losses therethrough. Each window is shielded above from rain, snow and grime by one of a pair of laterally extending combined visors and stiffening ribs 22, which may also be molded integrally with housing 10.

Within housing 10, a conventional, clear glass envelope bulb 24 is located at the focus of a deep-dish parabolic reflector surface 26, which is metallized directly onto the interior surface of housing 10. The interior surface of the lenses closing windows 18 and 20 are preferably metallized or silvered simultaneously with reflector surface 26, particularly when the lenses are formed integrally with housing 10. Bulb 24 is preferably oriented with its filament passing horizontally through the focus of reflector surface 26. Windows 18 and 20 are located so that the filament is centered on them to provide a good, bright side light; however, the silvering of the lenses prevents excessive brightness. A clear plastic bulb holder 28 supports bulb 24 and is attached within boss 12 by means of a molded-in nut and bolt combination 30. "Deep-dish" parabolic reflector as used herein, means that the forward edges of the reflector extend considerably beyond the vertical plane of the focus, so that a very large proportion of the light from the bulb, which is not emitted directly in the forward direction, will be reflected by reflector 26 in parallel rays toward the lens of the lamp. Generally, this arrangement ensures that an optimum portion of the light will be directed straight to the lens without random reflections from other portions of the housing which would reduce efficiency.

On the left side of housing 10 a pair of hinge support tabs 32 are provided which pivotably support an essentially cylindrical housing closure and lens support 33 having a corresponding pair of hinge tabs 34. Closure 33 comprises an essentially cylindrical body portion 36 having a radially extending seal flange 38 at its rear edge. Flange 38 comprises an annular slot for a seal gasket 40 which engages the front edge of housing 10 when closure 33 is swung shut on hinge tabs 32 and 34. On the lower right rear edge of body portion 36, a pair of spaced hasp tabs 42 are provided which cooperate with a corresponding apertured tab 44 extending radially from housing 10, to provide a convenient means for locking the lamp shut to minimize vandalism. At the bottom of housing 10, just to the rear of its foward edge, a plurality of drainage apertures 46 are provided for escape of moisture due to condensation or leakage.

The forward edge of lens support 33 is angled from the top of the lamp back toward the rear at an angle 48, which preferably is about 34° but may vary if desired. A lens 52 is integrally molded with cylindrical body portion 36 in position at the forward end of lens support 33. The angulated position of lens 52, which position is known in itself, is desirable to prevent accumulation of snow and grime on the face of the lens, as shown in U.S. Pat. No. 3,597,606. This configuration eliminates the need for a visor over the lens as commonly seen on prior art signal lamps and still provides a round, bright signal light when viewed from the front. The angled lens also is less sensitive to ambient light rays which can cause so-called "phantom" signals. Following molding, the interior and exterior faces of the lens are masked and the combination is painted inside and out, usually with a flat black paint.

Lens 52 is specially configured in accordance with the invention to distribute light reaching it preferentially laterally toward the roadway which crosses the railroad tracks, while still dispersing some light laterally to the adjacent areas. By this means, the signal will appear to be round and bright from any angle before it. To produce a still more uniform brightness at all angles before the lamp, lens 52 also is configured to distribute some light vertically at spaced locations or "bright spots" on the lens. The features of lens 52 which permit this preferred light distribution are shown in FIGS. 7 to 14.

Figure 7:
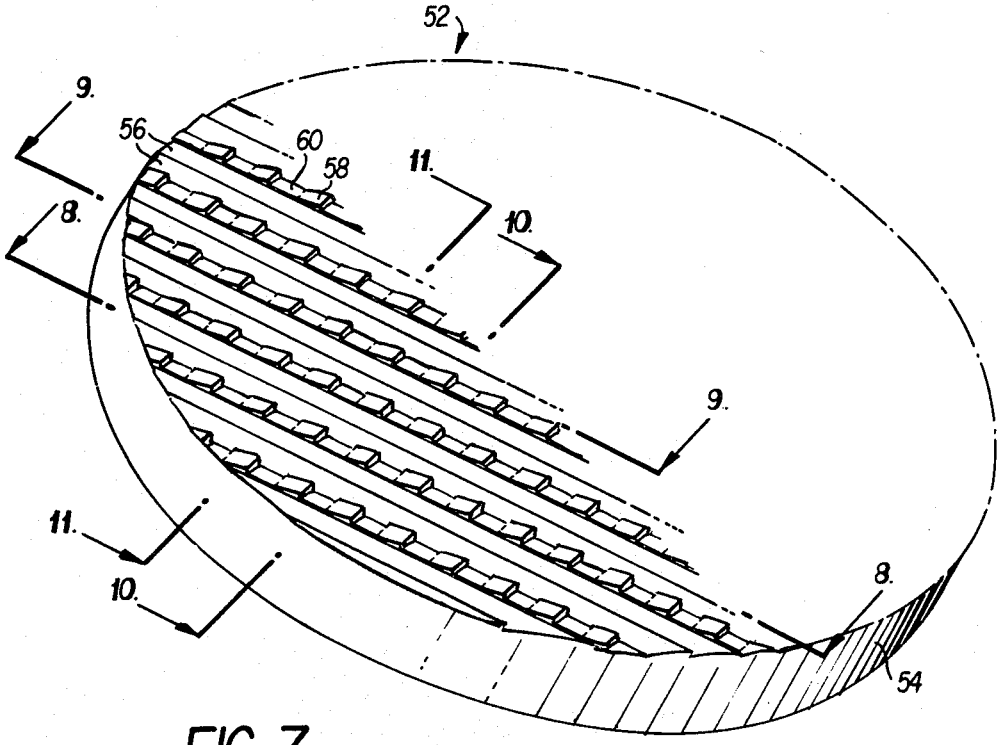
FIG. 7 shows a perspective view of a lens embodying the invention, viewed from the bulb side.

As shown in FIG. 7, lens 52 comprises an elliptically shaped, essentially flat disk having unique light dispersing elements on the back side, which face the bulb 24. The front side 54 is flat. In the preferred embodiment, lens 52 is made from a clear, red polycarbonate plastic, though other materials may also be used without departing from the scope of the invention; and is molded integrally with cylindrical body portion 36, though separate components may also be used. A plurality of prism elements 56 are provided which extend from top to bottom of the back face. Elements 56 preferentially disperse light laterally toward the roadway so that operators of vehicles and pedestrians approaching the railroad crossing will receive a major portion of the output of the lamp. A minor portion is directed toward the adjacent buildings, fields and so forth, and some light passes through with little or no dispersion. A plurality of segmented prism elements are provided which comprise alternate segments 58 having a geometry and function the same as elements 56, and segments 60 having a geometry which disperses light vertically. In the illustrated embodiment, pairs of elements 56 are separated by a segmented row of elements 58 and 60, and the alternate segmented rows are staggered vertically so that each segment 58 is laterally opposite a segment 60 in the next segmented row, and vice versa.

FIGS. 9 and 10 illustrate schematically the light dispersing function of elements 60 and 56, 58, respectively. The scale has been greatly exaggerated for purposes of illustration in FIGS. 8 to 11; however, FIGS. 12 to 14 show the details of one actual embodiment. FIG. 9 shows how prism elements 60 disperse light received from the lamp in the vertical direction. An incoming light ray $r_i$ contacts the surface of element 60 which is angled from its top edge back toward the lamp, as illustrated. Ray $r_i$ is bent toward normal $n_i$ as it enters the plastic of lens 52 and then away from normal $n_e$ when it departs as ray $r_e$. Thus, rays passing through elements 60 are not dispersed laterally from their initial plane of travel but are dispersed vertically within that plane.

FIG. 15 shows a cutting head 66 having a cutting surface 68 made up of a plurality of flat facets, as indicated, which is used to cut the mold surfaces for prism elements 60. The angulation and width of the facets are chosen to disperse light vertically and aim it to different areas before the lamp, so that the lamp will appear brightly at most angles. Because elements 60 are staggered in the successive rows of segmented prisms, no horizontal brightness stripes are produced which would detract from the rather uniform brightness of the lamp.

FIG. 10 shows how prism elements 56, 58 disperse light received from the lamp in the lateral direction. The surface of elements 56, 58 actually is faceted to have a rather convex appearance as will be discussed regarding FIGS. 12 to 14; however, FIG. 10 illustrates the principal. The incoming ray $r_i$ contacts the surface of elements 56 and is bent toward the normal $n_i$ as it enters lens 52, and then away from normal $n_e$ as it departs as ray $r_e$. So, rays hitting elements 58, 60 are dispersed laterally to various areas in front of the signal lamp.

FIG. 12 shows the cutting head 62 of a tool used to form the concave surface of the mold for prism elements 56, 58. The prism elements thus have the same shape as head 62 and actually comprise a plurality of thin flat facets which extend along the length of the prism. In selecting the angulation and width of these facets, consideration is given to the light distribution desired at various preselected locations or areas in front of the lamp. For some areas, light will be allowed to pass almost straight through the lens; and in others, it will be dispersed laterally to the desired location. In FIGS. 13 and 14, the specific sizes and angles of the facets for one embodiment are illustrated; however, variations on these details are possible within the scope of the invention. When cutting head 62 is used, its surface 64 removes metal from the lens mold to produce a concave, faceted surface. The lens material is then poured into the mold to produce the desired convex shape for elements 56. As shown in FIGS. 12 to 14, the facets on the left side, as illustrated, will disperse light laterally somewhat less than those on the right side, as illustrated, due to the differences in angulation. Thus light is preferentially dispersed laterally to one side of the area before the lens. By proper selection of the angles and facet widths, the required amount of light intensity is produced at points along the highway at progressively greater distances from the lamp; whereas, a proportionately much smaller amount of light is directed to the adjacent buildings and fields beside the highway. Due to this efficient distribution of the light coming from lamp 24, a lower power battery may be used than was possible with the prior lens design.

What we claim is:

1. An improved signal lamp for use at railroad crossings to warn pedestrians and vehicle operators approaching the railroad track along the crossing highway of the approach of a train, comprising:

a housing positioned adjacent said highway at said crossings, said housing defining an interior volume and a frontal opening;

parabolic reflector means located in said housing for projecting through said frontal opening essentially parallel light rays from a light source located essentially at the focus of the parabola defined by said reflector means;

a light transmitting closure attached to said housing, said closure defining a first hollow portion for passing said rays projected by said light source and having a translucent, distinctively colored lens oriented across said first hollow portion to intercept said rays, said lens having an essentially flat exterior face oriented at an angle to said rays with the top of said lens being further from said focus than the bottom of said lens, whereby said lens is rendered relatively free from phantom signals due to ambient light rays and from accumulation of snow, ice and grime on said exterior face, said lens having:

a first plurality of prism elements extending from the top to the bottom of said lens on the inside surface thereof for dispersing said rays laterally preferantially toward said crossing highway so that light from said source is directed to areas along said highway distant from said signal and to areas progressively closer to said signal whereby said signal may be easily viewed at points both distant from and close to said railroad; each of said prism elements comprising a first essentially convex surface facing said first hollow portion, said first convex surface being made up of a first plurality of essentially flat facets extending along said first convex surface, each facet being set at an angle relative to said rays each angle being chosen to disperse rays incident thereon laterally to a preselected area spaced from said signal;

a second plurality of segmented prism elements interspersed among said first plurality of prism elements and also extending from top to bottom of said lens, said segmented prism element having first spaced segments with faceted, convex surfaces of the type found in said first plurality of prism elements and second spaced segments interspersed among said first spaced segments, each of said second spaced segments comprising a second essentially convex surface facing into said first hollow portion, said second convex surface being made up of a second plurality of essentially flat facets, said facets being oriented transversely to said first plurality of essentially flat facets, each facet of said second plurality being set at an angle relative to said rays, each angle being chosen to disperse rays incident thereon vertically, whereby said lens provides a minimum brightness to observers in front of said lens.

2. A signal lamp according to claim 1, wherein said parabolic reflector means is a deep dish reflector to optimize collimation of the light and improve the efficiency of said lens.

3. A signal lamp according to claim 1, wherein said light source is an electrical bulb having a clear, transparent envelope, said bulb having a filament mounted horizontally at said focus.

4. A signal lamp according to claim 1, wherein said parabolic reflector means comprises a metallized surface formed on the interior surface of said housing.

5. A signal lamp according to claim 1, wherein said housing comprises windows on opposite sides thereof adjacent said focus whereby operation of said signal lamp may be confirmed by the operators of trains moving on said railroad track.

6. A signal lamp according to claim 1, wherein said housing comprises drain means in the lower portion thereof.

7. A signal lamp according to claim 1, wherein said first plurality of prism elements includes facets for directing a smaller intensity of light to areas on the opposite side of said signal lamp from said crossing highway so that most light is directed toward oncoming motorists and pedestrians on said highway.

8. An improved signal lamp for use at railroad crossings to warn pedestrians and vehicle operators approaching the railroad track along the crossing highway of the approach of a train, comprising:

a housing positioned adjacent said highway at said crossing, said housing defining an interior volume and a frontal opening;

parabolic reflector means located in said housing for projecting through said frontal opening essentially parallel light rays from a light source located essentially at the focus of the parabola defined by said reflector means;

a light transmitting closure removably attached to said housing, said closure defining a first hollow portion for passing said rays projected by said light source and having a translucent, distinctively colored lens oriented across said first hollow portion to intercept said rays, said lens having an essentially flat exterior face oriented at an angle to said rays with the top of said lens being further from said focus than the bottom of said lens, whereby said lens is rendered relatively free from phantom signals due to ambient light rays and from accumulation of snow, ice and grime on said exterior face, said lens comprising:

a first plurality of prism elements extending from the top to the bottom of said lens on the inside surface thereof for dispersing said rays laterally preferentially toward said crossing highway so that light from said course is directed to areas along said highway distant from said signal and to areas progressively closer to said signal whereby said signal may be easily viewed at points both distant from and close to said railroad; each of said prism elements comprising a first essentially convex surface facing said first hollow portion to disperse rays incident thereon laterally to preselected areas spaced from said signal;

a second plurality of segmented prism elements interspersed among said first plurality of prism elements and also extending from top to bottom of said lens, said segmented prism elements having first spaced segments with first convex surfaces of the type found in said first plurality of prism elements and second spaced segments interspersed among said first spaced segments, each of said second spaced segments comprising a second essentially convex surface facing into said first hollow portion, said second convex surface being oriented transversely to said first convex surfaces to disperse rays incident thereon vertically, whereby said lens provides a minimum brightness to observers in front of said lens.

9. A signal lamp according to claim 8, wherein said first convex surface is made up of a plurality of essentially flat facets extending along said first convex surface, each facet being set at an angle relative to said rays chosen to disperse rays incident thereon to a preselected area spaced from said signal.

10. A signal according to claim 8, wherein said second convex surface is made up of a plurality of essentially flat facets, said facets being oriented transversely to said first convex surfaces, each facet being set at an angle relative to said rays to disperse rays incident thereon vertically, whereby said lens provides a minimum brightness to observers in front of said lens.

11. A signal according to claim 1, wherein said hollow portion and said lens are integrally molded from clear, colored plastic.

12. A signal according to claim 5, wherein said windows are closed by clear plastic lenses, the interior surfaces of said lenses being metallized.

13. A signal according to claim 12, wherein said lenses are formed integrally with said housing.

14. A signal according to claim 8, wherein said hollow portion and said lens are integrally molded from clear, colored plastic.

* * * * *